US005469725A

United States Patent [19]

Yamada

[11] Patent Number: 5,469,725

[45] Date of Patent: Nov. 28, 1995

[54] DOOR LOCKING HANDLE ASSEMBLY OF PULL-OUT AND SIDE-SWINGING LEVER-ACTION TYPE

[75] Inventor: Kenichi Yamada, Tokyo, Japan

[73] Assignee: Takigen Manufacturing Co., Ltd., Tokyo, Japan

[21] Appl. No.: 197,068

[22] Filed: Feb. 16, 1994

[30] Foreign Application Priority Data

Mar. 16, 1993 [JP] Japan ..... 5-081289

[51] Int. Cl.[6] ..... E05B 13/10

[52] U.S. Cl. ..... 70/208; 70/210; 70/215; 70/224; 292/202; 292/207; 292/210; 292/336; 292/DIG. 31

[58] Field of Search ..... 70/208, 210, 215, 70/224, 467, 469, 489, 192–197, 201, 205, 462, 466, DIG. 31, DIG. 33; 292/202, DIG. 31, DIG. 72, 244, 241, 210, 336, 335, 207, 336.3

[56] References Cited

U.S. PATENT DOCUMENTS

| | | | |
|---|---|---|---|
| 2,873,495 | 2/1959 | Love | 292/DIG. 31 X |
| 3,044,815 | 7/1962 | Soss | 70/208 |
| 3,782,141 | 1/1974 | Doerrfeld | 292/DIG. 31 X |
| 3,936,082 | 2/1976 | Swanson | 292/DIG. 31 X |
| 4,134,281 | 1/1979 | Pelcin | 292/210 X |
| 4,268,077 | 5/1981 | Bohleen et al. | 292/210 X |
| 4,510,779 | 4/1985 | Ahad | 70/208 |
| 5,060,492 | 10/1991 | Carpenter et al. | 292/DIG. 31 X |
| 5,201,557 | 4/1993 | Schlack | 292/161 |
| 5,321,962 | 6/1994 | Ferchau et al. | 70/208 |
| 5,347,834 | 9/1994 | Ramsauer | 70/120 |

FOREIGN PATENT DOCUMENTS

| | | |
|---|---|---|
| 198764 | 12/1988 | Japan . |
| 66369 | 6/1991 | Japan . |

*Primary Examiner*—Lloyd A. Gall
*Attorney, Agent, or Firm*—Martin Smolowitz

[57] ABSTRACT

A door locking handle assembly of pull-out and side-swinging lever-action type, in which the entire length of a casing 1 is minimized while an effective length of a handle 18 is obtained sufficiently to improve the assembly in operability. A catch plate 36 is fixed to a locking shaft 11 mounted in a cylindrical portion 2 of the casing 1. The handle 18 received in a front concave 3 of the casing 1 is pivoted to the shaft 11 through a first pivot 37, and swingably urged by a spring 38 to project outwardly. In the front concave portion 3 of the casing 1, a push button 30 is pivoted to a button casing 24 through a second pivot 39, and urged by a position-keeping spring 40 to have its engaging-hook portion 31 engaged with an engaging projection 25 of the button casing 24. A rotor 42 of a lock unit 41 fixedly embedded in the handle 18 is interlocked with a lock plate 45 engaging with an engaging projection 26 of the button casing 24.

4 Claims, 4 Drawing Sheets

DOOR LOCKING HANDLE ASSEMBLY OF PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type. The door locking handle assembly is used in a plugboard box and the like. In operation, the retractable handle of the assembly is pulled out of its casing and side-swung through a predetermined angle to permit a catch plate of the assembly to be free from a receiving portion of a stationary frame element.

2. Description of the Prior Art

In a conventional door locking handle assembly of a pull-out and side swinging lever-action type disclosed in Japanese Utility Model Laid-Open No. Sho 63-198764: a cylinder portion is provided in a base-end portion of a casing fixedly mounted on a door; a locking shaft is rotatably mounted in the cylindrical portion in an insertion manner; a catch plate is fixedly mounted on a rear-end portion of the locking shaft; a retractable handle folds into a front concave portion of the casing, and has its base-end portion pivoted to a front-end portion of the locking shaft through a cross pivot; a biasing spring-for swingably biasing the retractable handle in its projecting direction on the cross pivot, the biasing spring being mounted between the locking shaft and the handle; a locking aperture is provided in a finger-engaging projecting portion of a front-end portion's rear surface of the handle; a lock unit is fixedly embedded in a lock-receiving portion provided in a front-end portion of the casing; and, a latch element is so arranged as to be interlocked with a rotor of the lock unit, and is biased forward towards the finger-engaging projecting portion by a return spring to have a front-end portion of the latch element engaged with the locking aperture so that the handle is locked up in its retracted position.

However, in the conventional door locking handle assembly described above, there is a fear that the front-end portion of the handle hits a user's fingers. Namely, when the user inserts a key into the lock unit to have its rotor rotated in an unlocking direction thereof, the latch element slidably moves backward to be free from the locking aperture of the handle, so that the handle is projected forward and turned under the influence of a resilience force exerted by a biasing spring, whereby the front-end portion of the handle hits the user's fingers.

In order to prevent the handle from hitting the user's fingers, it is sufficient to dispose the lock unit in a position far away from the front-end portion of the handle. However, naturally, this causes the entire length of the casing to increase. In order to set a sufficient interval between the lock unit and the handle without increasing the entire length of the casing, it is sufficient to decrease the handle in length. However, when a grip portion of the handle is extremely shortened, the handle is impaired in operability. Consequently, such shortening of the grip portion of the handle is not adequate.

SUMMARY OF THE INVENTION

It is an object, of the present invention to provide a door locking flush handle assembly of a pull-out and side-swinging lever-action type, in which assembly a grip portion of a handle has a sufficient effective length while the entire length of a casing is minimized with improved operability.

The above objects of the present invention are accomplished by providing:

a door locking handle assembly of a pull-out and side-swinging lever-action type, comprising:

a casing fixedly mounted on a door;

a locking shaft rotatably mounted in a cylindrical portion of a base-end portion of the casing in an insertion manner, the locking shaft being non-axially slidable in the cylindrical portion and having its rear-end portion fixed to a catch plate;

a retractable handle which folds into a front concave portion of the casing, and has its base-end portion pivoted to a front-end portion of the locking shaft through a first cross pivot, the handle being provided with a lock-receiving portion and an engaging projection in its front-end portion;

a biasing spring for swingably biasing the retractable handle in its projecting direction on the first cross pivot, the biasing spring being mounted between the locking shaft and the handle;

a button casing which is fixedly mounted in a front-end portion of the front concave portion of the casing, and provided with an engaging projection in its front-end portion side and another engaging projection in an intermediate portion of its base-end portion side;

a push button pivoted to a front-end portion of the button casing through a second cross pivot, the push button being provided with an engaging-hook portion in its front-end portion;

a position-keeping spring which is interposed between the button casing and the push button, and resiliently forces the push button to swing on the second cross pivot so as to have the engaging-hook portion of the push button engaged with the engaging projection of the button casing;

a lock unit fixedly embedded in the lock-receiving portion of the front-end portion of the handle; and a lock plate which is interlocked with a rotor of the lock unit so as to move back and forth as the rotor rotates;

wherein the engaging-hook portion of the front-end portion of the handle engages with a rear surface of a base-end portion side of the push button, so that the handle is held in its retracted position, and the lock plate engages with the engaging projection of the button casing to have the handle locked up.

DESCRIPTION OF THE PREFERRED EMBODIMENTS

Figure 1:
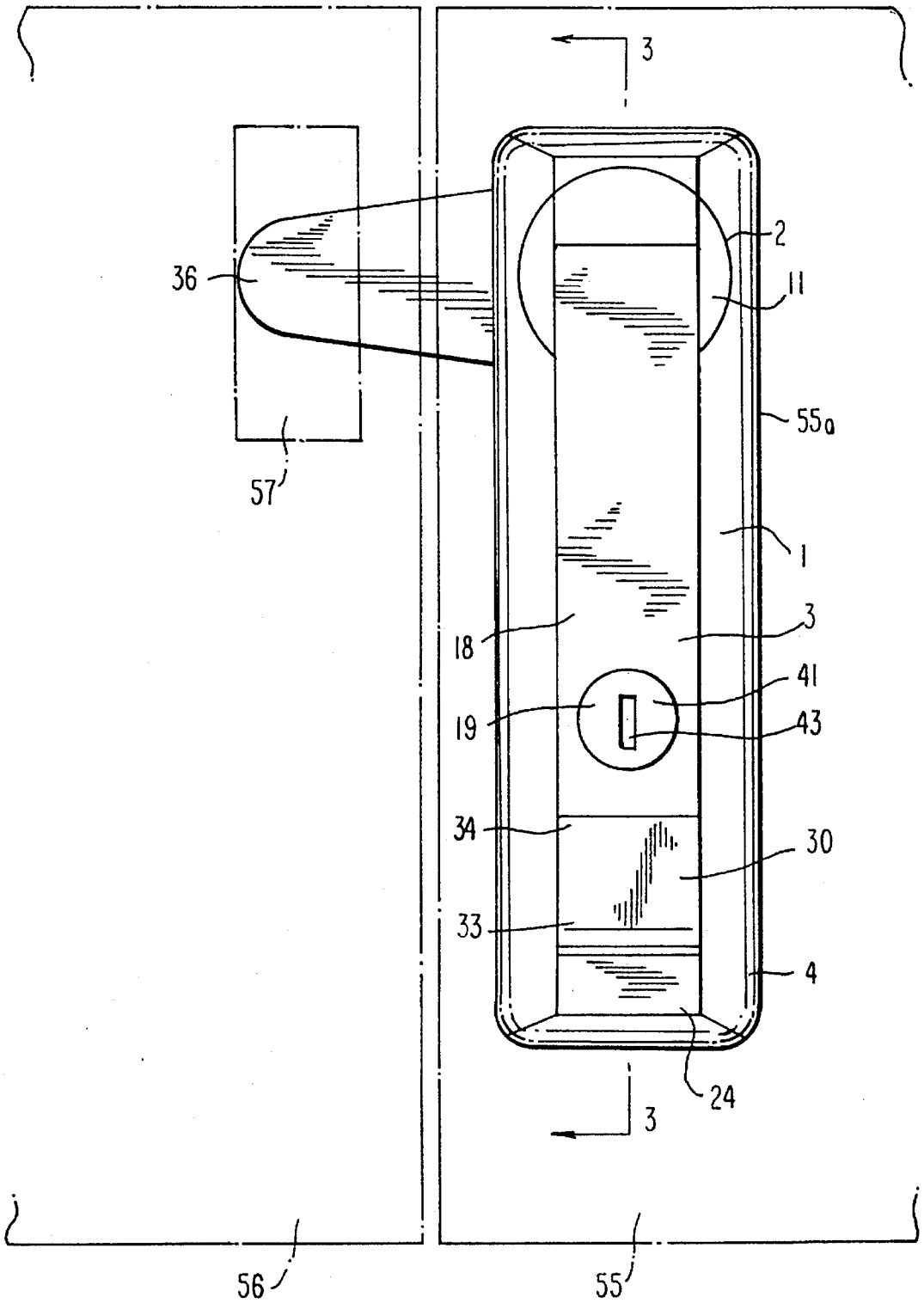
FIG. 1 is a front view of an embodiment of the door locking handle assembly of a pull-out and side-swinging lever-action type of the present invention.

Hereinbelow, the present invention will be described in detail with reference to the accompanying drawings and the reference numerals and characters.

In a door locking handle assembly of a pullout and side-swinging type according to the present invention, as shown in FIGS. 1–6, a casing 1 is fixedly mounted on a door 55, and provided with a cylindrical portion 2 in the casing base-end portion. Rotatably mounted in the cylindrical portion 2 is a locking shaft 11 to a rear-end portion of which a catch plate 36 is fixedly mounted.

A retractable handle 18 folds into a front concave portion 3 of the casing 1 so as to be projectable therefrom. The handle 18 has its base-end portion pivoted to a front-end portion of the locking shaft 11 through a first cross pivot 37. A biasing spring 38 is disposed between the locking shaft 11 and the handle 18, and forces the handle 18 to swing on the first cross pivot 37 in a projecting direction of the handle 18.

A button casing 24 is fixedly mounted in a front-end portion of the front concave portion 3 of the casing 1, and is provided with an engaging projection 25 in its front-end portion side and another engaging projection 26 in an intermediate portion of its base-end portion side. A push button 30 is pivoted to a front-end portion of the button casing 24 through a second cross pivot 39, and provided with an engaging-hook portion 31 in its front-end portion. A position-keeping spring 40 is interposed between the button casing 24 and the push button 30, and resiliently forces the push button 30 to swing on the second cross pivot 39, so as to have the engaging-hook portion 31 of the push button 30 engaged with the engaging projection 25 of the button casing 24.

Provided in the front-end portion of the handle 18 is an engaging-hook portion 20, which engages with a rear surface 32 of the base-end portion of the push button 30 to hold the handle 18 in its retracted position.

A lock unit 41 is fixedly embedded in a lock-receiving portion 19 of the front-end portion of the handle 18. A lock plate 45 is interlocked with a rotor 42 of the lock unit 41 so as to move back and forth as the rotor 42 rotates. In operation, the engaging-hook portion 20 of the front-end portion of the handle 18 engages with the rear surface 32 of the base-end portion side of the push button 30, so that the handle 18 is held in its retracted position, and then the lock plate 45 engages with the engaging projection 26 of the button casing 24 to have the handle 18 locked up in its retracted position.

Figure 3:
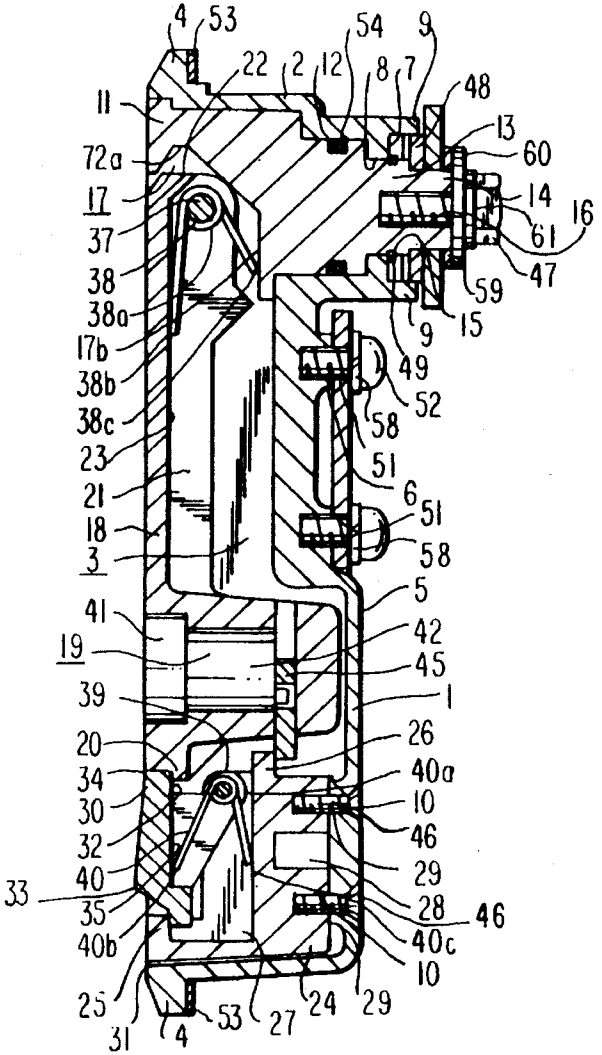
FIG. 3 is a sectional view of the door locking assembly of the present invention, taken along the line 3—3 of FIG. 1.

As shown in FIG. 3, the catch plate 36 having been fixed to the rear-end portion of the locking shaft 11 engages with a receiving portion 57 of a stationary frame element 56. In case that the handle 18 is in its retracted position in the front concave portion 3 of the casing 1, although the push button 30 is urged by the position-keeping spring 40 to project its front-end portion outward from a notch portion 27 of the button casing 24, since the engaging-hook portion 31 of the push button 30 engages with the engaging projection 25 of the button casing 24, the push button 30 is aligned with the handle 18 along an extension line of the handle 18, which has its front end engaging-hook portion 20 engaged with the rear surface 32 of the base-end portion of the push button 30 and is held in its, retracted position. At this time, the lock plate 45 reaches its most advanced position in which the lock plate 45 engages with the engaging projection 26 of the button casing 24 to lock up the handle 18 in the retracted position thereof, so that the door 55 is locked up relative to the stationary frame element 56 without fail.

Figure 4:
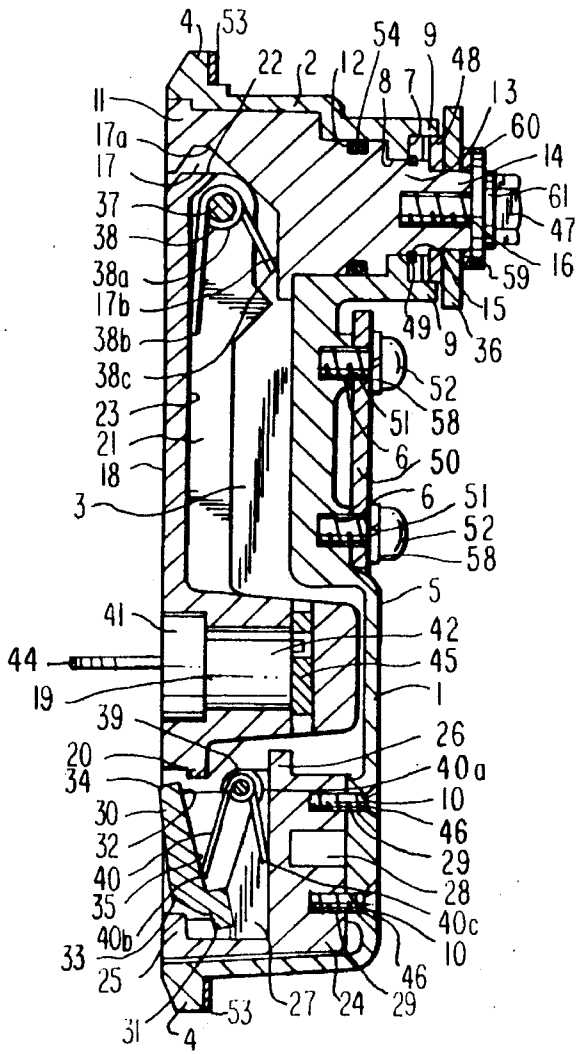
FIG. 4 is a sectional view of the door locking assembly of the present invention shown in FIG. 1 in a condition in which the push button is depressed.

In case that the handle 18 is to be projected, as shown in FIG. 4 a key 44 is inserted in a keyhole 43 of the lock unit 41 to rotate the rotor 42 so that the lock plate 45 is moved back, whereby the engaging projection 26 of the button casing 24 is disengaged from the lock plate 45. At this time, since the engaging-hook portion 20 of the fronts-end portion of the handle 18 is still engaged with the rear surface 32 of the base-end portion of the push button 30, the handle 18 is also still held in its retracted position. When the user depresses a front end surface portion 33 of the push button 30, the push button 30 swings oil the second cross pivot 39 against the resilient force exerted by the position-keeping spring 40, whereby the engaging-hook portion 20 of the front-end portion of the handle 18 is disengaged from the rear surface 32 of the base-end portion of the push button 30. As a result, the handle 18 is immediately projected outwardly from the front concave portion 3 of the casing 1 under the influence of the resilient force exerted by the biasing spring 38.

Figure 5:
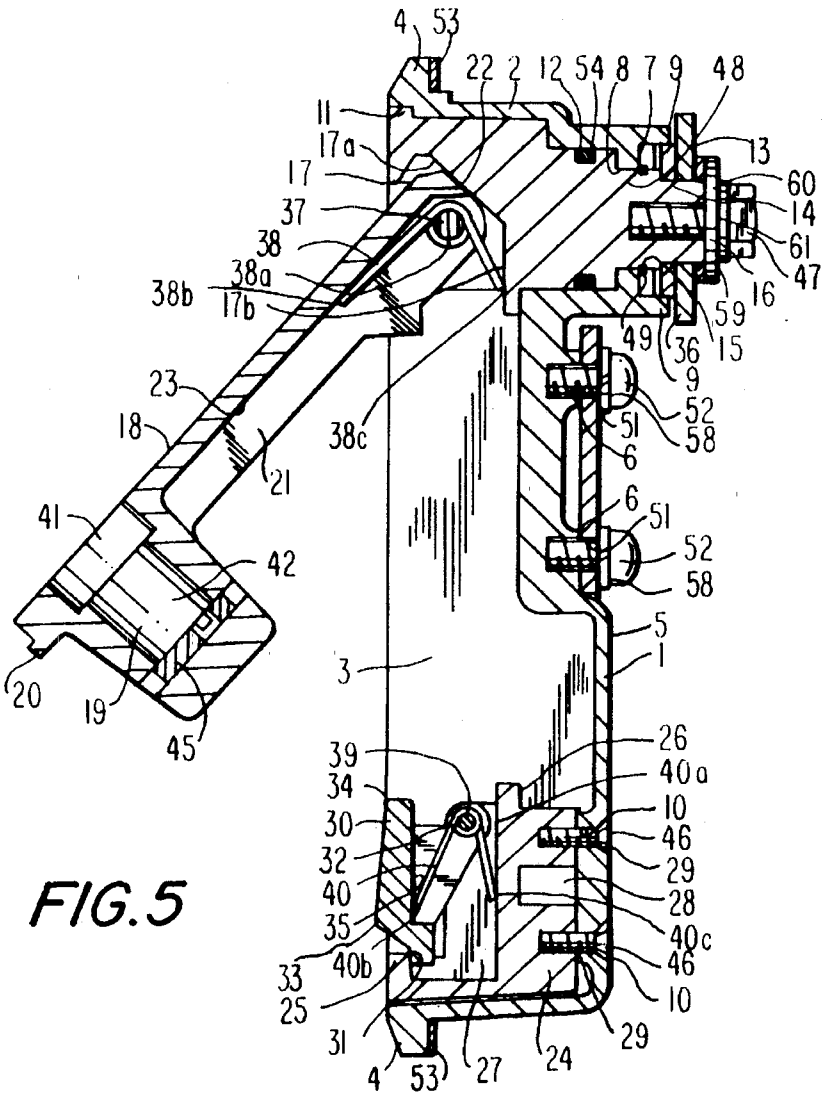
FIG. 5 is a sectional view similar to FIG. 4, in which the handle is swingably projected outwardly.

As shown in FIG. 5, when the handle 18 is projected outwardly and the push button 30 is released from the depressing effort of the user, the push button 30 swings on the second cross pivot 39 under the influence of the resilient force exerted by the position-keeping spring 40 so that the engaging-hook portion 31 of the push button 30 engages with the engaging projection 25 of the button casing 24, whereby the push button 30 is aligned with the handle 18 along the extension line of the handle 18. When the user swings the thus projected handle 18 sideward in a predetermined direction as shown in FIG. 5, the locking shaft 11 having been pivoted to the handle 18 through the first cross pivot 37 rotates or swings in the cylindrical portion 2 of the casing 1 together with the handle 18, so that the catch plate 36 is disengaged from the receiving portion 57 of the stationary frame element 56, whereby the door 55 is unlocked relative to the stationary frame element 56. As a result, the user may open the thus unlocked door 55 by pulling it forward. In this opening operation of the door 55, the lock-receiving portion 19 of the front-end portion of the handle 18 also serves as a suitable finger-engaging portion.

Figure 6:
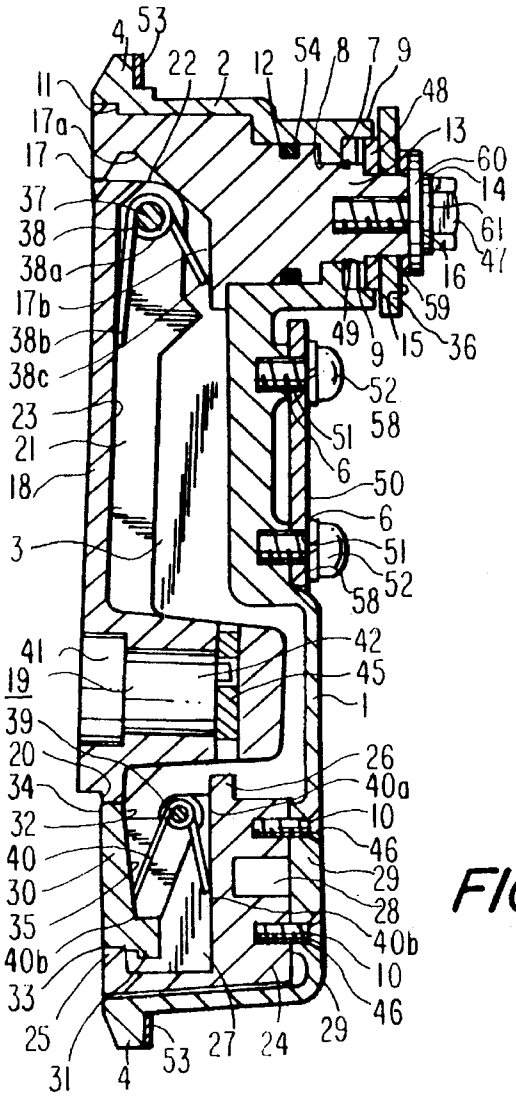
FIG. 6 is a sectional view similar to FIG. 4, in which the handle is swingably retracted.

After the door 55 is closed and the handle 18 is swung back to have the catch plate 36 engaged again with the receiving portion 57 of the stationary frame element 56, the handle 18 is pushed into the front concave portion 3 of the casing 1. As this time, as shown in FIG. 6, the engaging-hook portion 20 of the front-end portion of the handle 18 pushes the base-end portion 34 of the push button 30, so that the push button 30 is temporarily swung against the resilient force exerted by the position-keeping spring 40. When the handle 18 is further pushed in so that the engaging-hook portion 20 of the frond-end portion of the handle 18 clears the rear surface 32 of the base-end portion of the push button 30, the push button 30 is immediately swung under the influence of the resilient force exerted by the position-keeping spring 40 to have its engaging-hook portion 31 engaged with the engaging projection 25 of the button casing 24. As a result, the push button 30 is aligned with the handle 18 along the extension line thereof, so that the handle 18 having its front end engaging-hook portion 20 engage with the rear surface 32 of the base-end portion of the push button 30 is held in its retracted position in the casing 1. Under such circumstances, the key 44 is inserted in the keyhole 43 to rotate the rotor 42 so that the lock plate 45 is moved downward to have its lower-end portion engaged with the engaging projection 26 of the button casing 24. As a result, as shown in FIG. 3, the handle 18 is locked up in its retracted position without fail so that the door 55 is locked up relative to the stationary frame element 56.

Figure 2:
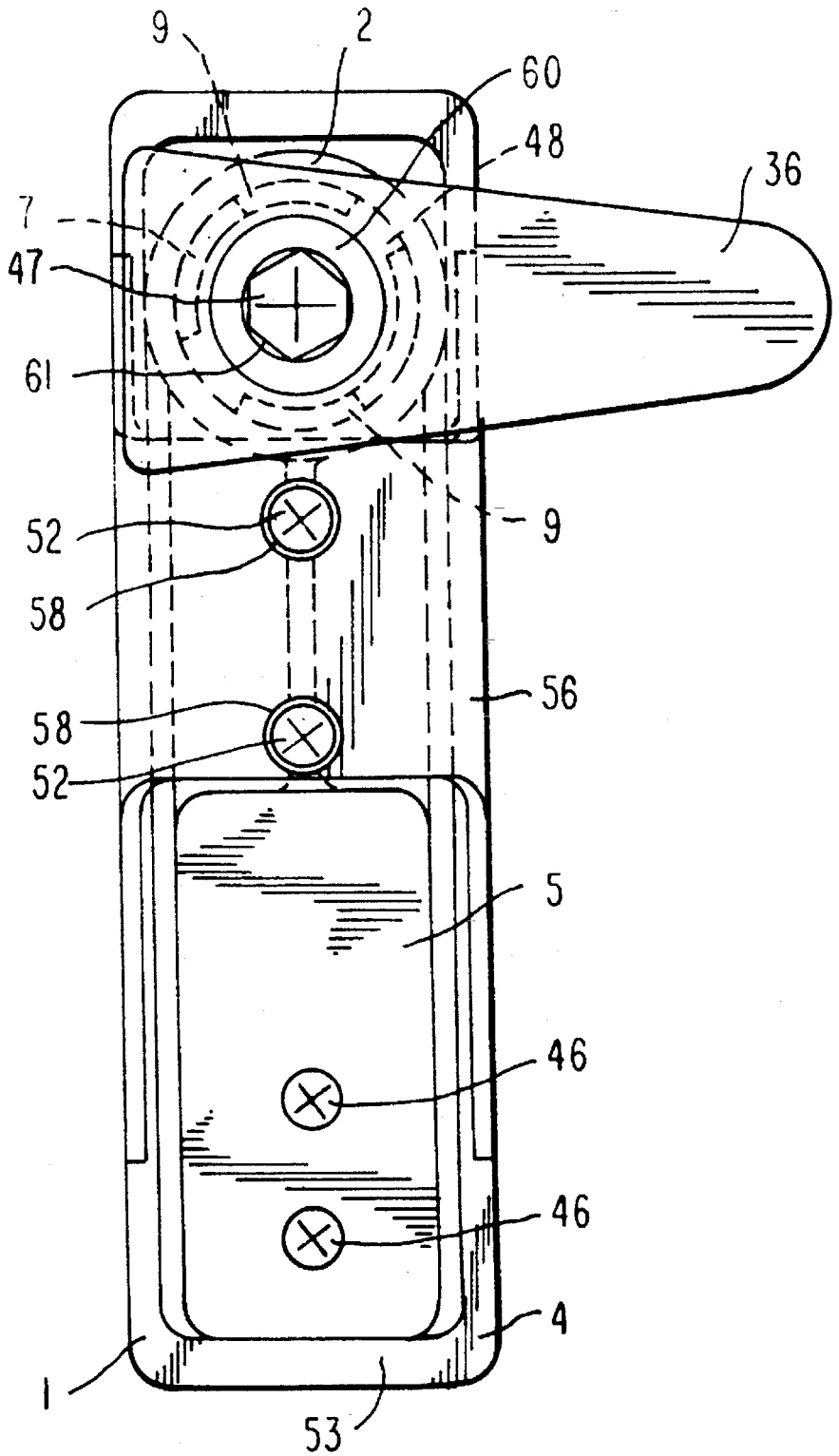
FIG. 2 is a rear view of the door locking assembly of the present invention shown in FIG. 1.

In the embodiment of the present invention shown in the drawings, as shown in FIGS. 1–3, the casing 1 is fixedly mounted in the door 55 as follows. Namely, first, the casing 1 is inserted into a longitudinal opening portion 55*a* of the door 55 from its front side, and has its outer peripheral flange portion 4 abutted against a front surface of the door 55. Then, a U-shaped sheet metal bracket 50, which covers an intermediate portion of the casing 1 in its rear side, is abutted against a rear surface of the door 55, and fixedly mounted on the door 55 through tapping screws 52 each of which passes through a through-hole 51 of the sheet metal bracket 50 and is threadably connected with a blind hole 6 formed in a rear wall 5 of the above intermediate portion of the casing 1. A packing 53 is interposed between a front surface of the door 55 and the casing 1.

A watertight O-ring 54 is fitted in an annular groove 12 of the intermediate portion of the locking shaft 11, which has its small-diameter portion 13 fitted in an axial hole 8 of a rear-surface wall portion 7 of the cylindrical portion 2 of the casing 1. The small-diameter portion 13 of the locking shaft 11 is followed by a square-column portion 14 on which both a swing-angle limiting plate 48 and the catch plate 36 are mounted in an insertion manner. Then a bolt 47 is threadably connected with a threaded hole 16 of the square-column portion 14 to have these plates 48, 36 fixed to the square-column portion 14, so that the locking shaft 11 is rotatably mounted in the cylindrical portion 2 of the casing 1, but non-axially slidable therein to prevent the locking shaft 11 from dropping out of the cylindrical portion 2 of the casing 1. Fitted in an annular groove 15 of the small-diameter portion 13 of the locking shaft 11 an O-ring 49 which also serves as a means preventing the locking shaft 11 from dropping out of the cylindrical portion 2 of the casing 1. A swing-angle limiting projection 9, which abuts against the swing-angle limiting plate 48 to cooperate therewith to limit the handle 18 in swinging angle, is provided in the rear wall portion 7 of the casing 1 to limit the handle 18 in side-swinging angle.

Formed in a front-end portion of the locking shaft 11 is a recess 17, pivoted in which recess 17 through the first cross pivot 37 is the base-end Portion of the handle 18, which portion is formed into a semicircular shape as viewed in FIGS. 3 to 6, so that the handle 18 obliquely projected from the casing 1 is swung or rotated together with the locking shaft 11 while supported by the cylindrical portion 2 of the casing 1. A pair of ribs 21 are provided in opposite side surfaces of the handle 18. A flat-surface portion 22 of the base-end portion of the handle 18 abuts against an oblique surface 17*a* of the recess 17 of the locking shaft 11 to determine a projecting angle of the handle 18 relative to the casing 1. The biasing spring 38 is constructed of a coil spring 38. The spring 38 has its coiled portion 38*a* mounted on the first cross pivot 37 in an insertion manner, and its linear portion 38*c* abut against the bottom surface 17*b* of the recess 17 of the locking shaft 11. In addition, the biasing spring 38 has its remaining linear portion 38*b* abut against the rear surface 23 of the handle 18.

Provided in the front-end portion of the button casing 24 is a notch portion 27 in which the push button 30 is pivoted to the button casing 24 through the second cross pivot 39. The position-keeping spring 40 is constructed of a coil spring, which has its coiled portion 40*a* mounted on the second cross pivot 39 in an insertion manner, and its linear portion 40*c* abut against the bottom surface of the button casing 24. In addition, the biasing spring 40 has its remaining linear portion 40*b* abut against the rear surface 35 of the push button 30.

Provided in the rear-surface side of the button casing 24 is a recess 28 in which a projection of a bottom portion of the front-end portion of the front concave portion 3 of the casing 1 is inserted to position the push button 30. Further provided in the rear-surface side of the button casing 24 are a pair of threaded holes 29 which are threadably engaged with screws 46 having passed through through-holes 10 of the rear wall portion 5 of the casing 1, so that the button casing 24 is fixedly mounted in the front-end portion of the front concave portion of the casing 1.

In the embodiment of the present invention, a disk-tumbler locking mechanism is used as a lock mechanism for locking the rotor 42 of the lock unit 41 to the main body of the lock unit 41. However, it is also possible to use any other suitable lock mechanisms such as radial-pin tumbler locking mechanisms, axial-pin tumbler mechanisms and the like.

As described above, in the door locking handle assembly of a pull-out and side-swinging type according to the present invention: the retractable handle 18 folds into the front concave portion 3 of the casing 1 so as to be projectable therefrom, and has its base-end portion pivoted to a front-end portion of the locking shaft 11 through a first cross pivot 37; the biasing spring 38 is disposed between the locking shaft 11 and the handle 18, and forces the handle 18 to swing on the first cross pivot 37 in a projecting direction of the handle 18; the button casing 24 is fixedly mounted in the front-end portion of the front concave portion 3 of the casing 1, and provided with the engaging projection 25 in its front-end portion side and another engaging projection 26 in the intermediate portion of its base-end portion side; the push button 30 is pivoted to the front-end portion of the button casing 24 through the second cross pivot 39, and provided with the engaging-hook portion 31 in its front-end portion; the position-keeping spring 40 is interposed between the button casing 24 and the push button 30, and resiliently forces the push button 30 to swing on the second cross pivot 39 so as to have the engaging-hook portion 31 of the push button 30 engaged with the engaging projection 25 of the button casing 24. Provided in the front-end portion of the handle 18 is the engaging-hook portion 20 which engages with the rear surface 32 of the base-end portion of the push button 30 to hold the handle 18 in its retracted position; the lock unit 41 is fixedly embedded in the lock-receiving portion 19 of the front-end portion of the handle 18; the lock plate 45 is interlocked with the rotor 42 of the lock unit 41 so as to move back and forth as the rotor 42 rotates; and, the engaging-hook portion 20 of the front-end portion of the handle 18 engages with the rear surface of the base-end portion side of the push button 30, so that the handle 18 is held in its retracted position, and then the lock plate 45 engages with the engaging projection 26 of the button casing 24 to have the handle 18 locked up in its retracted position. Consequently, the handle 18 is projected from the casing 1 when the push button 30 is depressed by the user's finger after the lock unit 41 is operated, so that the rear surface 32 of the base-end portion of the push button 30 is disengaged from the engaging-hook portion 20 of the handle 18. At this time, the user's finger has been moved out of the front surface portion of the handle 18, and, therefore there is no fear that the user's finger is hit by the front-end portion of the handle 18. Consequently, it is possible to minimize the clearance between the push button 30 and the handle 18. In addition, it is also possible to effectively use the lock-receiving portion 19 of the handle 18 as the finger-engaging portion, which makes it possible to reduce the handle 18 in length by the length of its lock-receiving portion 19. As a result, according to the present invention, the entire length of the casing 1 is minimized while keeping the sufficient effective length of the grip portion of the handle 18.

Furthermore, according to the mechanism of the present invention as described above, it is possible to smoothly perform the pull-out and push-in operations of the handle 18 relative to the casing 1, which improve the door locking handle assembly of the present invention in operability.

What is claimed is:

1. A door locking handle assembly of a pull-out and side-swinging lever-action type, comprising:

a casing (1) for fixedly mounting on a door (55);

a locking shaft (11) rotatably mounted in a cylindrical portion (2) of a base-end portion of said casing (1) in an insertion manner, said locking shaft (11) being non-axially slidable in said cylindrical portion (2) and having its rear-end portion fixed to a catch plate (36);

a retractable handle (18) which folds into a front concave portion (3) of said casing (1), and has its base-end portion pivoted to a front-end portion of said locking shaft (11) through a first cross pivot (37), said handle (18) being provided with a lock-receiving portion (19) and an engaging projection (20) in its front-end portion;

a biasing spring (38) for swingably biasing said handle (18) in its projecting direction on said first cross pivot (37), said biasing spring (38) being mounted between said locking shaft (11) and said handle (18);

a button casing (24) which is fixedly mounted in a front-end portion of said front concave portion (3) of said casing (1), and provided with an engaging projection (25) in its front-end portion side and another engaging projection (26) in an intermediate portion of its base-end portion side;

a push button (30) pivoted to a front-end portion of said button casing (24) through a second Cross pivot (39), said push button (30) being provided with an engaging-hook portion (31) in its front-end portion;

a position-keeping spring (40) which is interposed between said button casing (24) and said push button (30), and resiliently forces said push button (30) to swing on said second cross pivot (39) so as to have said engaging-hook portion (31) of said push button (30) engaged with said engaging projection (25) of said button casing (24);

a lock unit (41) fixedly embedded in said lock-receiving portion (19) of said front-end portion of said handle (18); and a lock plate (45) which is interlocked with a rotor (42) of said lock unit (41) so as to move back and forth as said rotor (42) rotates;

wherein said engaging projection (20) of said front-end portion of said handle (18) engages with a rear surface (32) of a base-end portion side of said push button (30), so that the handle (18) is held in its retracted position, and said lock plate (45) engages with said another engaging projection (26) of said button casing (24) to have said handle (18) locked up.

2. The door locking handle assembly of claim 1, wherein said casing (1) is fixedly mounted on a door (35) and said catch plate (36) is arranged to engage with a receiving portion (57) of a stationary frame (56).

3. The door locking handle assembly of claim 1, wherein said casing (1) is inserted into an opening portion of a door (55), and said casing has a peripheral flange portion (4) abutted against a front surface of the door with a packing (53) interposed therebetween.

4. The door locking handle assembly of claim 1, wherein said handle (18) is pivoted by said first cross pivot (37) in a recess (17) of said locking shaft 15, and a flat surface portion (22) of the handle abuts against an oblique surface (**17*a*) of said recess (17) so as to determine the outwardly projecting angle of the handle relative to the casing (1**).

* * * * *